US012352127B2

(12) United States Patent
Fripp et al.

(10) Patent No.: US 12,352,127 B2
(45) Date of Patent: Jul. 8, 2025

(54) VOLTAGE TO ACCELERATE/DECELERATE EXPANDABLE METAL

(71) Applicant: Halliburton Energy Services, Inc., Houston, TX (US)

(72) Inventors: Michael Linley Fripp, Carrollton, TX (US); Luke Holderman, Dallas, TX (US); Richard Decena Ornelaz, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 372 days.

(21) Appl. No.: 17/151,468

(22) Filed: Jan. 18, 2021

(65) Prior Publication Data

US 2021/0222510 A1 Jul. 22, 2021

Related U.S. Application Data

(60) Provisional application No. 62/962,901, filed on Jan. 17, 2020.

(51) Int. Cl.
*E21B 33/12* (2006.01)

(52) U.S. Cl.
CPC ..... *E21B 33/1208* (2013.01)

(58) Field of Classification Search
CPC ..... E21B 33/1208; E21B 33/1212
See application file for complete search history.

(56) References Cited

U.S. PATENT DOCUMENTS 1,525,740 A 2/1925 Howard
2,075,912 A 4/1937 Roye
2,590,931 A 4/1952 Cabaniss
2,743,781 A 5/1956 Lane
2,865,454 A 12/1958 Richards
3,206,536 A 9/1965 Goodloe
3,371,716 A 3/1968 Current
(Continued)

FOREIGN PATENT DOCUMENTS

CA 2820742 A1 9/2013
CN 203308412 U 11/2013
(Continued)

OTHER PUBLICATIONS

Fripp, Michael, and Zachary Walton. "Degradable Metal for Use in a Fully Dissolvable Frac Plug." Paper presented at the Offshore Technology Conference, Houston, Texas, USA, May 2016. doi: https://doi.org/10.4043/27187-MS (Year: 2016).*
(Continued)

*Primary Examiner* — Theodore N Yao
(74) *Attorney, Agent, or Firm* — Scott Richardson; Parker Justiss, P.C.

(57) ABSTRACT

Provided is a method for setting a downhole tool, and a downhole tool, and a well system employing the same. The method, in at least one aspect, includes positioning a downhole tool within a wellbore, the downhole tool including expandable metal configured to expand in response to hydrolysis, and subjecting the expandable metal to a wellbore fluid to expand the expandable metal into contact with one or more surfaces. The method, in at least one aspect, further includes applying a voltage to the expandable metal while the expandable metal is being subjected to the wellbore fluid.

20 Claims, 9 Drawing Sheets

(56) References Cited

U.S. PATENT DOCUMENTS 3,616,354 A 10/1971 Russell
3,706,125 A 12/1972 Hopkins
4,270,608 A 6/1981 Hendrickson
4,424,859 A 1/1984 Sims
4,424,861 A 1/1984 Carter
4,442,908 A 4/1984 Steenbock
4,446,932 A 5/1984 Hipp
4,457,379 A 7/1984 McStravick
4,527,815 A 7/1985 Frick
4,977,636 A 12/1990 King
4,979,585 A 12/1990 Chesnutt
5,139,274 A 8/1992 Oseman
5,220,959 A 6/1993 Vance
5,424,139 A 6/1995 Shuler
5,492,173 A 2/1996 Kilgore
5,517,981 A 5/1996 Taub et al.
5,662,341 A 9/1997 Ezell et al.
5,667,015 A 9/1997 Harestad
5,803,173 A 9/1998 Fraser et al.
6,089,320 A 7/2000 LaGrange
6,106,024 A 8/2000 Herman et al.
6,840,325 B2 1/2005 Stephenson
6,907,930 B2 6/2005 Cavender
6,942,039 B2 9/2005 Tinker
7,104,322 B2 9/2006 Whanger et al.
7,152,687 B2 12/2006 Gano
7,322,408 B2 1/2008 Howlett
7,347,274 B2 3/2008 Patel
7,350,590 B2 4/2008 Hosie et al.
7,402,277 B2 7/2008 Ayer
7,578,043 B2 8/2009 Simpson et al.
7,673,688 B1 3/2010 Jones
7,677,303 B2 3/2010 Coronado
7,696,275 B2 4/2010 Slay et al.
7,963,321 B2 6/2011 Kutac
7,996,945 B2 8/2011 Nosker
8,042,841 B2 10/2011 Viegener
8,109,339 B2 2/2012 Xu
8,225,861 B2 7/2012 Foster et al.
8,266,751 B2 9/2012 He
8,430,176 B2 4/2013 Xu
8,453,736 B2 6/2013 Constantine
8,459,367 B2 6/2013 Nutley et al.
8,469,084 B2 6/2013 Clark et al.
8,490,707 B2 7/2013 Robisson
8,579,024 B2 11/2013 Mailand et al.
8,684,096 B2 4/2014 Harris
8,794,330 B2 8/2014 Stout
8,807,209 B2 8/2014 King
8,875,800 B2 11/2014 Wood et al.
8,894,070 B2 11/2014 Bhat et al.
8,993,491 B2 3/2015 James
9,004,173 B2 4/2015 Richard
9,217,311 B2 12/2015 Slup
9,249,904 B2 2/2016 Duquette
9,279,295 B2 3/2016 Williamson et al.
9,347,272 B2 5/2016 Hewson et al.
9,353,606 B2 5/2016 Bruce et al.
9,393,601 B2 7/2016 Ranck
9,404,030 B2 8/2016 Mazyar
9,534,460 B2 1/2017 Watson et al.
9,611,715 B1 4/2017 Smith
9,644,459 B2 5/2017 Themig
9,708,880 B2 7/2017 Solhaug
9,725,979 B2 8/2017 Mazyar et al.
9,732,578 B2 8/2017 McRobb
9,745,451 B2 8/2017 Zhao et al.
9,765,595 B2 9/2017 Themig et al.
9,771,510 B2 9/2017 James et al.
9,945,190 B2 4/2018 Crowley
9,976,380 B2 5/2018 Davis et al.
9,976,381 B2 5/2018 Martin et al.
10,030,467 B2 7/2018 Al-Gouhi
10,060,225 B2 8/2018 Wolf
10,119,011 B2 11/2018 Zhao et al.
10,179,873 B1 1/2019 Meng
10,316,601 B2 6/2019 Walton et al.
10,337,298 B2 7/2019 Braddick
10,344,570 B2 7/2019 Steele
10,352,109 B2 7/2019 Sanchez
10,364,636 B2 7/2019 Davis
10,472,933 B2 11/2019 Steele
10,533,392 B2 1/2020 Walton et al.
10,718,183 B2 7/2020 Bruce et al.
10,758,974 B2 9/2020 Sherman
10,794,152 B2 10/2020 Lang et al.
10,961,804 B1 3/2021 Fripp
11,359,448 B2 6/2022 Fripp
11,365,611 B2 6/2022 Gibb
11,428,066 B2 8/2022 Andersen
11,512,552 B2 11/2022 Fripp
2002/0088616 A1 7/2002 Swor et al.
2003/0132001 A1 7/2003 Wilson
2003/0164236 A1 9/2003 Thornton
2003/0164237 A1 9/2003 Butterfield, Jr.
2003/0205377 A1 11/2003 Streater
2004/0194970 A1* 10/2004 Eatwell ..... E21B 33/126 166/387
2005/0051333 A1 3/2005 Weber
2005/0061369 A1 3/2005 De Almeida
2005/0072576 A1 4/2005 Henriksen
2005/0093250 A1 5/2005 Santi et al.
2005/0199401 A1 9/2005 Patel et al.
2006/0144591 A1 7/2006 Gonzalez
2006/0272806 A1 12/2006 Wilkie et al.
2007/0089875 A1 4/2007 Steele et al.
2007/0089910 A1 4/2007 Hewson et al.
2007/0095532 A1 5/2007 Head
2007/0137826 A1 6/2007 Bosma et al.
2007/0144734 A1 6/2007 Xu et al.
2007/0151724 A1 7/2007 Ohmer et al.
2007/0163781 A1 7/2007 Walker
2007/0221387 A1 9/2007 Levy
2007/0246213 A1 10/2007 Hailey
2007/0267824 A1 11/2007 Baugh et al.
2007/0277979 A1 12/2007 Todd et al.
2008/0047708 A1 2/2008 Spencer
2008/0135249 A1* 6/2008 Fripp ..... E21B 43/088 166/65.1
2008/0149351 A1 6/2008 Marya
2008/0290603 A1 11/2008 Laflin
2009/0014173 A1 1/2009 Macleod
2009/0084555 A1 4/2009 Lee
2009/0102133 A1 4/2009 Ruddock
2009/0159278 A1 6/2009 Corre
2009/0200028 A1 8/2009 Dewar
2009/0250227 A1 10/2009 Brown et al.
2009/0250228 A1 10/2009 Loretz
2009/0272546 A1 11/2009 Nutley et al.
2009/0321087 A1 12/2009 Victorov
2010/0072711 A1 3/2010 Doane
2010/0078173 A1 4/2010 Buytaert et al.
2010/0096143 A1 4/2010 Angman
2010/0108148 A1 5/2010 Chen
2010/0122819 A1 5/2010 Wildman
2010/0139930 A1 6/2010 Patel
2010/0155083 A1 6/2010 Lynde et al.
2010/0181080 A1 7/2010 Levy
2010/0225107 A1 9/2010 Tverlid
2010/0257913 A1 10/2010 Storm, Jr. et al.
2010/0307737 A1 12/2010 Mellemstrand
2011/0061876 A1 3/2011 Johnson et al.
2011/0098202 A1* 4/2011 James ..... C09K 8/5086 507/221
2011/0147014 A1 6/2011 Chen et al.
2012/0018143 A1 1/2012 Lembcke
2012/0048531 A1 3/2012 Marzouk
2012/0048561 A1 3/2012 Holderman
2012/0048623 A1 3/2012 Lafuente et al.
2012/0049462 A1 3/2012 Pitman
2012/0168147 A1 7/2012 Bowersock
2012/0175134 A1 7/2012 Robisson
2012/0273236 A1 11/2012 Gandikota et al.
2013/0048289 A1 2/2013 Mazyar et al.

(56) References Cited

U.S. PATENT DOCUMENTS

2013/0056207 A1 3/2013 Wood et al.
2013/0056209 A1 3/2013 Mazyar et al.
2013/0081815 A1 4/2013 Mazyar et al.
2013/0152824 A1 6/2013 Crews
2013/0153236 A1 6/2013 Bishop
2013/0161006 A1 6/2013 Robisson et al.
2013/0186615 A1 7/2013 Hallunbaek et al.
2013/0192853 A1 8/2013 Themig
2013/0292117 A1 11/2013 Robisson
2014/0026335 A1 1/2014 Smith
2014/0034308 A1 2/2014 Holderman
2014/0051612 A1 2/2014 Mazyar
2014/0262352 A1 9/2014 Lembcke
2015/0021049 A1 1/2015 Davis et al.
2015/0075768 A1 3/2015 Wright et al.
2015/0101813 A1 4/2015 Zhao
2015/0113913 A1 4/2015 Kim
2015/0184486 A1 7/2015 Epstein
2015/0233190 A1 8/2015 Wolf et al.
2015/0275587 A1 10/2015 Wolf et al.
2015/0337615 A1 11/2015 Epstein et al.
2015/0345248 A1 12/2015 Carragher
2015/0368990 A1 12/2015 Jewett
2015/0369003 A1 12/2015 Hajjari et al.
2016/0024896 A1 1/2016 Johnson et al.
2016/0024902 A1 1/2016 Richter
2016/0137912 A1 5/2016 Sherman et al.
2016/0138359 A1 5/2016 Zhao
2016/0138559 A1 5/2016 Bauer
2016/0145488 A1 5/2016 Aines et al.
2016/0145968 A1* 5/2016 Marya ..... E21B 33/1208 166/386
2016/0177668 A1 6/2016 Watson et al.
2016/0194936 A1 7/2016 Allen
2016/0208569 A1 7/2016 Anderson et al.
2016/0230495 A1 8/2016 Mazyar et al.
2016/0273312 A1 9/2016 Steele et al.
2016/0319633 A1 11/2016 Cooper et al.
2016/0326830 A1 11/2016 Hallundbaek
2016/0326849 A1 11/2016 Bruce
2016/0333187 A1 11/2016 Bauer et al.
2017/0015824 A1 1/2017 Gozalo
2017/0022778 A1 1/2017 Fripp et al.
2017/0107419 A1 4/2017 Roy et al.
2017/0107794 A1 4/2017 Steele
2017/0113275 A1 4/2017 Roy et al.
2017/0159401 A1 6/2017 Saltel et al.
2017/0175487 A1 6/2017 Marcin et al.
2017/0175488 A1 6/2017 Lisowski
2017/0191342 A1 7/2017 Turley
2017/0198191 A1 7/2017 Potapenko
2017/0234103 A1 8/2017 Frazier
2017/0306714 A1 10/2017 Haugland
2017/0314372 A1 11/2017 Tolman
2017/0350237 A1 12/2017 Giem et al.
2017/0356266 A1 12/2017 Arackakudiyil
2018/0023362 A1 1/2018 Makowiecki et al.
2018/0023366 A1 1/2018 Deng et al.
2018/0038193 A1 2/2018 Walton
2018/0078998 A1 3/2018 Sherman
2018/0080304 A1 3/2018 Cortez et al.
2018/0081468 A1 3/2018 Bruce et al.
2018/0086894 A1 3/2018 Roy
2018/0087350 A1 3/2018 Sherman
2018/0094508 A1 4/2018 Smith et al.
2018/0100367 A1* 4/2018 Perez ..... E21B 29/02
2018/0128072 A1 5/2018 Larsen
2018/0128082 A1 5/2018 Hollan et al.
2018/0209234 A1 7/2018 Manera
2018/0223624 A1 8/2018 Fripp
2018/0298708 A1 10/2018 Schmidt et al.
2018/0334882 A1 11/2018 Brandsdal
2018/0347288 A1* 12/2018 Fripp ..... E21B 43/08
2018/0363409 A1 12/2018 Frazier
2019/0016951 A1 1/2019 Sherman et al.
2019/0032435 A1 1/2019 Kochanek et al.
2019/0039126 A1 2/2019 Sherman
2019/0078414 A1 3/2019 Frazier
2019/0128092 A1 5/2019 Mueller et al.
2019/0136666 A1 5/2019 Kent
2019/0178054 A1 6/2019 Bruce
2019/0186228 A1 6/2019 Beckett et al.
2019/0225861 A1 7/2019 Reddy
2019/0249510 A1 8/2019 Deng et al.
2019/0316025 A1 10/2019 Sherman
2019/0383115 A1 12/2019 Lees
2020/0032574 A1 1/2020 Fripp et al.
2020/0056435 A1* 2/2020 Sherman ..... E21B 41/0085
2020/0072019 A1 3/2020 Onti et al.
2020/0080401 A1 3/2020 Sherman
2020/0080402 A1 3/2020 Lang et al.
2020/0240235 A1 7/2020 Fripp et al.
2020/0308945 A1 10/2020 Surjaatmadja et al.
2020/0325749 A1 10/2020 Fripp et al.
2020/0362224 A1 11/2020 Wellhoefer
2020/0370391 A1 11/2020 Fripp et al.
2021/0017835 A1 1/2021 Pelto et al.
2021/0040810 A1 2/2021 Evers
2021/0123310 A1 4/2021 Fripp et al.
2021/0123319 A1 4/2021 Greci
2021/0172286 A1 6/2021 Barlow
2021/0187604 A1 6/2021 Sherman et al.
2021/0270093 A1 9/2021 Fripp
2021/0270103 A1 9/2021 Greci et al.
2021/0332673 A1 10/2021 Fripp
2021/0363849 A1 11/2021 Al Yahya
2022/0106847 A1 4/2022 Dahl
2022/0186575 A1 6/2022 Fripp
2022/0205336 A1 6/2022 Asthana
2022/0372837 A1 11/2022 Holderman et al.

FOREIGN PATENT DOCUMENTS

CN 205422632 U 8/2016
CN 107148444 A 9/2017
CN 108194756 A 6/2018
CN 107148444 B 1/2019
CN 108194756 B 8/2020
EP 15726 A1 9/1980
EP 869257 A2 10/1998
EP 940558 A1 9/1999
EP 0940558 B1 1/2005
EP 1757770 A1 2/2007
EP 1910728 A1 4/2008
EP 1910728 B1 9/2009
EP 2447466 A2 5/2012
EP 2501890 A2 9/2012
EP 2501890 B 7/2014
EP 2447466 A3 3/2017
EP 3144018 A1 3/2017
EP 3144018 A4 5/2017
EP 3196402 A1 7/2017
EP 3144018 B1 9/2018
EP 2447466 B1 10/2018
GB 2444060 A 5/2008
GB 2444060 B 12/2008
JP 2003090037 A 3/2003
JP 2003293354 A 10/2003
JP 2004169303 A 6/2004
JP 2015175449 A 10/2015
KR 20020014619 A 2/2002
KR 20080096576 A 10/2008
WO 02/02900 A2 1/2002
WO 02/02900 A3 5/2002
WO 02/02900 A8 12/2003
WO 2005/022012 A1 3/2005
WO 2006/045794 A1 5/2006
WO 2007/047089 A1 4/2007
WO 2012/094322 A2 7/2012
WO 2012/125660 A2 9/2012
WO 2012/094322 A3 10/2012
WO 2012/125660 A3 2/2013
WO 2014/028149 A1 2/2014
WO 2014/182301 A1 11/2014

(56) References Cited

FOREIGN PATENT DOCUMENTS

| | | | |
|---|---|---|---|
| WO | 2014/193042 | A1 | 12/2014 |
| WO | 2015/057338 | A1 | 4/2015 |
| WO | 2015/069886 | A2 | 5/2015 |
| WO | 2015099909 | A1 | 7/2015 |
| WO | 2015/069886 | A3 | 9/2015 |
| WO | 2015/183277 | A1 | 12/2015 |
| WO | 2016/000068 | A1 | 1/2016 |
| WO | 2016/171666 | A1 | 10/2016 |
| WO | 2017/100417 | A1 | 6/2017 |
| WO | 2018/055382 | A1 | 3/2018 |
| WO | 2018085102 | A1 | 5/2018 |
| WO | 2019/094044 | A1 | 5/2019 |
| WO | 2019/122857 | A1 | 6/2019 |
| WO | 2019/147285 | A1 | 8/2019 |
| WO | 2019/151870 | A1 | 8/2019 |
| WO | 2019/164499 | A1 | 8/2019 |
| WO | 2020/005252 | A1 | 1/2020 |
| WO | 2020/141203 | A1 | 7/2020 |
| WO | 2019/164499 | A8 | 8/2020 |
| WO | 2020/167288 | A1 | 8/2020 |
| WO | 2020/204940 | A1 | 10/2020 |
| WO | 2021/034325 | A1 | 2/2021 |
| WO | 2021/086317 | A1 | 5/2021 |
| WO | 2021/096519 | A1 | 5/2021 |
| WO | 2021/126279 | A1 | 6/2021 |

OTHER PUBLICATIONS

Merchant B. Gold, the noble metal and the paradoxes of its toxicology. Biologicals. Mar. 1998;26(1):49-59. doi: 10.1006/biol.1997.0123. PMID: 9637749. (Year: 1998).*

Fripp, et al. "Novel Expanding Metal Alloy for Non-Elastomeric Sealing and Anchoring." Paper presented at the SPE Annual Technical Conference and Exhibition, Houston, Texas, USA, Oct. 2022. doi: https://doi.org/10.2118/210273-MS (Year: 2022).*

* cited by examiner

VOLTAGE TO ACCELERATE/DECELERATE EXPANDABLE METAL

CROSS-REFERENCE TO RELATED APPLICATION

This application claims the benefit of U.S. Provisional Application Ser. No. 62/962,901, filed on Jan. 17, 2020, entitled "VOLTAGE TO ACCELERATE EXPANDABLE METAL," commonly assigned with this application and incorporated herein by reference in its entirety.

BACKGROUND

Wellbores are drilled into the earth for a variety of purposes including accessing hydrocarbon bearing formations. A variety of downhole tools may be used within a wellbore in connection with accessing and extracting such hydrocarbons. Throughout the process, it may become necessary to isolate sections of the wellbore in order to create pressure zones. Downhole tools, such as frac plugs, bridge plugs, packers, and other suitable tools, may be used to isolate wellbore sections.

The aforementioned downhole tools are commonly run into the wellbore on a conveyance, such as a wireline, work string or production tubing. Such tools often have either an internal or external setting tool, which is used to set the downhole tool within the wellbore and hold the tool in place, and thus function as a wellbore anchor. The wellbore anchors typically include a plurality of slips, which extend outwards when actuated to engage and grip a casing within a wellbore or the open hole itself, and a sealing assembly, which can be made of rubber and extends outwards to seal off the flow of liquid around the downhole tool.

BRIEF DESCRIPTION

Reference is now made to the following descriptions taken in conjunction with the accompanying drawings, in which.

DETAILED DESCRIPTION

Figure 1:
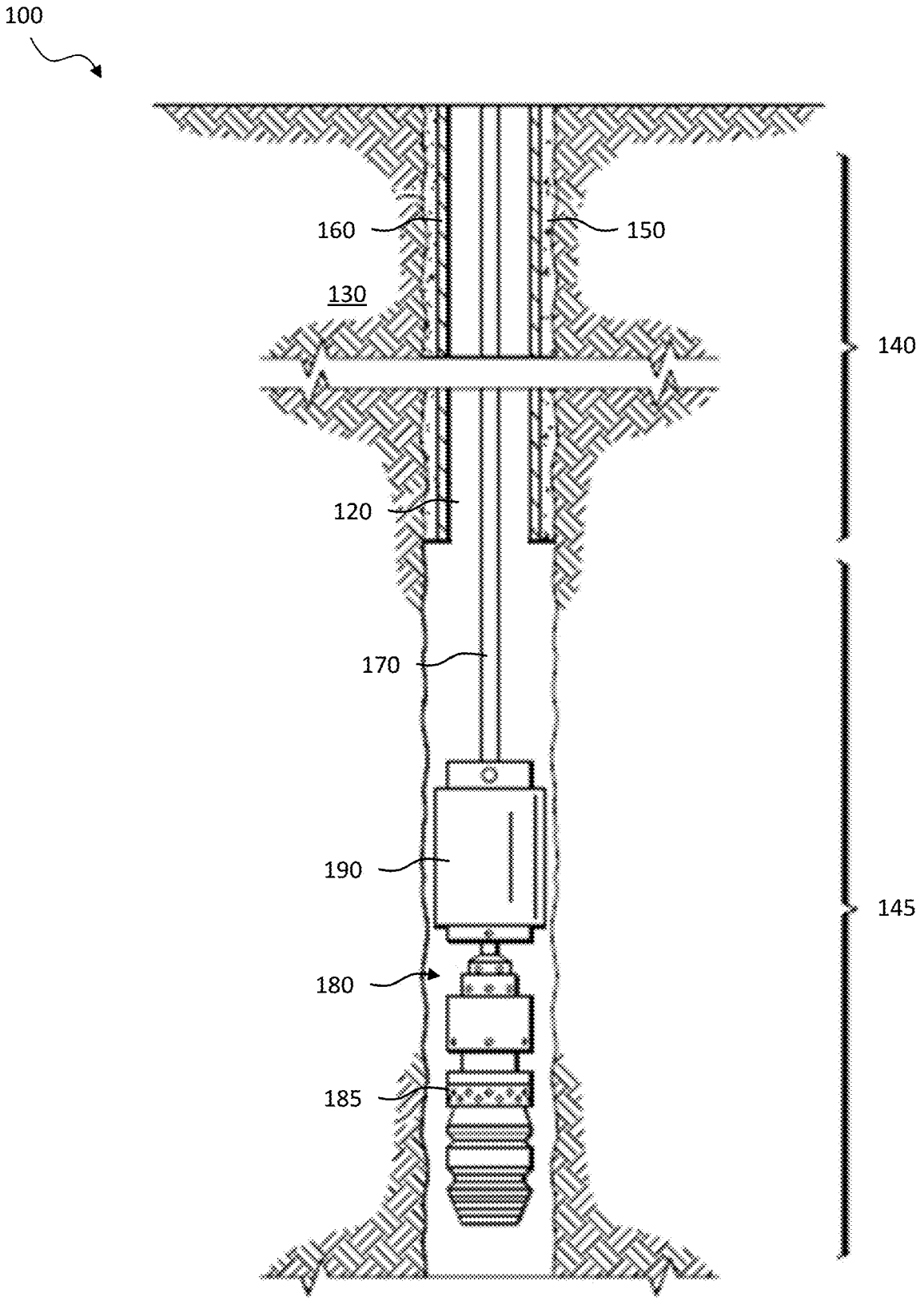
FIG. 1 illustrates a perspective view of a well system including an exemplary operating environment that the apparatuses, systems and methods disclosed herein may be employed.

In the drawings and descriptions that follow, like parts are typically marked throughout the specification and drawings with the same reference numerals, respectively. The drawn figures are not necessarily, but may be, to scale. Certain features of the disclosure may be shown exaggerated in scale or in somewhat schematic form and some details of certain elements may not be shown in the interest of clarity and conciseness.

The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results. Moreover, all statements herein reciting principles and aspects of the disclosure, as well as specific examples thereof, are intended to encompass equivalents thereof. Additionally, the term, "or," as used herein, refers to a non-exclusive or, unless otherwise indicated.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the well; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical or horizontal axis. Unless otherwise specified, use of the term "subterranean formation" shall be construed as encompassing both areas below exposed earth and areas below earth covered by water, such as ocean or fresh water.

Referring to FIG. 1, depicted is a perspective view of a well system 100 including an exemplary operating environment that the apparatuses, systems and methods disclosed herein may be employed. For example, the well system 100 could use a downhole tool according to any of the embodiments, aspects, applications, variations, designs, etc. disclosed in the following paragraphs. The term downhole tool, as used herein and without limitation, includes frac plugs, bridge plugs, packers, and other tools for fluid isolation, as well as wellbore anchors, among any other downhole tools employing expandable metal.

The well system 100 illustrated in the embodiment of FIG. 1 includes a wellbore 120 formed in a subterranean formation 130. As those skilled in the art appreciate, the wellbore 120 may be fully cased, partially cased, or an open hole wellbore. In the illustrated embodiment of FIG. 1, the wellbore 120 is partially cased, and thus includes a cased region 140 and an open hole region 145. The cased region 140, as is depicted, may employ casing 150 that is held into place by cement 160.

The well system 100 illustrated in FIG. 1 additionally includes a downhole conveyance 170 deploying a downhole tool assembly 180 within the wellbore 120. The downhole conveyance 170 can be, for example, tubing-conveyed, wireline, slickline, work string, or any other suitable means for conveying the downhole tool assembly 180 into the wellbore 120. In one particular advantageous embodiment, the downhole conveyance 170 is American Petroleum Institute "API" pipe.

The downhole tool assembly 180, in the illustrated embodiment, includes a downhole tool 185 and a wellbore anchor 190. The downhole tool 185 may comprise any downhole tool that could be positioned within a wellbore.

Certain downhole tools that may find particular use in the well system 100 include, without limitation, sealing elements, sealing packers, elastomeric sealing packers, non-elastomeric sealing packers (e.g., including plastics such as PEEK, metal packers such as inflatable metal packers, as well as other related packers), liners, an entire lower completion, one or more tubing strings, one or more screens, one or more production sleeves, etc. The wellbore anchor 190 may comprise any wellbore anchor that could anchor the downhole tool 185 within a wellbore. In certain embodiments, the downhole tool 185 is deployed without the wellbore anchor 190, and in certain other embodiments the wellbore anchor 190 is deployed without the downhole tool 185.

In accordance with the disclosure, at least a portion of the downhole tool 185 or the wellbore anchor 190 may include expandable metal. In some embodiments, all or part of the downhole tool 185 or the wellbore anchor 190 may be fabricated using expandable metal configured to expand in response to hydrolysis. The expandable metal, in some embodiments, may be described as expanding to a cement like material. In other words, the expandable metal goes from metal to micron-scale particles and then these particles expand and lock together to, in essence, fix the downhole tool 185 or the wellbore anchor 190 in place. The reaction may, in certain embodiments, occur in less than 2 days in a reactive fluid and in downhole temperatures. Nevertheless, the time of reaction may vary depending on the reactive fluid, the expandable metal used, and the downhole temperature, as well as other aspects discussed further below.

In some embodiments the reactive fluid may be a brine solution such as may be produced during well completion activities, and in other embodiments, the reactive fluid may be one of the additional solutions discussed herein. The expandable metal, pre-expansion, is electrically conductive in certain embodiments. The expandable metal may be machined to any specific size/shape, extruded, formed, cast or other conventional ways to get the desired shape of a metal, as will be discussed in greater detail below. The expandable metal, pre-expansion, in certain embodiments has a yield strength greater than about 8,000 psi, e.g., 8,000 psi+/−50%. In other embodiments, the expandable metal is a slurry of expandable metal particles.

The hydrolysis of any metal can create a metal hydroxide. The formative properties of alkaline earth metals (Mg—Magnesium, Ca—Calcium, etc.) and transition metals (Zn—Zinc, Al—Aluminum, etc.) under hydrolysis reactions demonstrate structural characteristics that are favorable for use with the present disclosure. Hydration results in an increase in size from the hydration reaction and results in a metal hydroxide that can precipitate from the fluid.

The hydration reactions for magnesium is:

$$Mg+2H_2O \rightarrow Mg(OH)_2+H_2,$$

where $Mg(OH)_2$ is also known as brucite. Another hydration reaction uses aluminum hydrolysis. The reaction forms a material known as Gibbsite, bayerite, and norstrandite, depending on form. The hydration reaction for aluminum is:

$$Al+3H_2O \rightarrow Al(OH)_3+3/2H_2.$$

Another hydration reactions uses calcium hydrolysis. The hydration reaction for calcium is:

$$Ca+2H_2O \rightarrow Ca(OH)_2+H_2,$$

Where $Ca(OH)_2$ is known as portlandite and is a common hydrolysis product of Portland cement. Magnesium hydroxide and calcium hydroxide are considered to be relatively insoluble in water. Aluminum hydroxide can be considered an amphoteric hydroxide, which has solubility in strong acids or in strong bases.

In an embodiment, the expandable metal used can be a metal alloy. The metal alloy can be an alloy of the base metal with other elements in order to either adjust the strength of the metal alloy, to adjust the reaction time of the metal alloy, or to adjust the strength of the resulting metal hydroxide byproduct, among other adjustments. The metal alloy can be alloyed with elements that enhance the strength of the metal such as, but not limited to, Al—Aluminum, Zn—Zinc, Mn—Manganese, Zr—Zirconium, Y—Yttrium, Nd—Neodymium, Gd—Gadolinium, Ag—Silver, Ca—Calcium, Sn—Tin, and Re—Rhenium, Cu—Copper. In some embodiments, the alloy can be alloyed with a dopant that promotes corrosion, such as Ni—Nickel, Fe—Iron, Cu—Copper, Co—Cobalt, Ir—Iridium, Au—Gold, C—Carbon, gallium, indium, mercury, bismuth, tin, and Pd—Palladium. The metal alloy can be constructed in a solid solution process where the elements are combined with molten metal or metal alloy. Alternatively, the metal alloy could be constructed with a powder metallurgy process. The expandable metal can be cast, forged, extruded, a combination thereof, or may be a slurry of expandable metal particles.

Optionally, non-expanding components may be added to the starting expandable metal. For example, ceramic, elastomer, glass, or non-reacting metal components can be embedded in the expandable metal or coated on the surface of the metal. Alternatively, the starting expandable metal may be the metal oxide. For example, calcium oxide (CaO) with water will produce calcium hydroxide in an energetic reaction. Due to the higher density of calcium oxide, this can have a 260% volumetric expansion where converting 1 mole of CaO goes from 9.5 cc to 34.4 cc of volume. In one variation, the expandable metal is formed in a serpentinite reaction, a hydration and metamorphic reaction. In one variation, the resultant material resembles a mafic material. Additional ions can be added to the reaction, including silicate, sulfate, aluminate, and phosphate. The expandable metal can be alloyed to increase the reactivity or to control the formation of oxides.

The expandable metal can be configured in many different fashions, as long as an adequate volume of material is available for fully expanding. For example, the expandable metal may be formed into a single long tube, multiple short tubes, rings, alternating steel and swellable rubber and expandable metal rings, among others. Additionally, a coating may be applied to one or more portions of the expandable metal to delay the expanding reactions.

In application, the downhole tool assembly 180 can be moved down the wellbore 120 via the downhole conveyance 170 to a desired location. Once the downhole tool assembly 180, including the downhole tool 185 and/or the wellbore anchor 190 reaches the desired location, one or both of the downhole tool 185 and/or the wellbore anchor 190 may be set in place according to the disclosure. In one embodiment, one or both of the downhole tool 185 and/or the wellbore anchor 190 include the expandable metal, and thus are subjected to a wellbore fluid sufficient to expand the one or more expandable metal members into contact with a nearby surface, and thus in certain embodiments seal or anchor the one or more downhole tools within the wellbore.

In the embodiment of FIG. 1, the downhole tool 185 and/or the wellbore anchor 190 are positioned in the open hole region 145 of the wellbore 120. The downhole tool 185 and/or the wellbore anchor 190 including the expandable metal are particularly useful in open hole situations, as the expandable metal is well suited to adjust to the surface irregularities that may exist in open hole situations. Moreover, the expandable metal, in certain embodiments, may penetrate into the formation of the open hole region 145 and create a bond into the formation, and thus not just at the surface of the formation. Notwithstanding the foregoing, the downhole tool 185 and/or the wellbore anchor 190 are also suitable for a cased region 140 of the wellbore 120.

In certain embodiments, it is desirable or necessary to accelerate and/or decelerate the expansion of the expandable metal. The present disclosure has recognized that a voltage (e.g., provided via a power source, whether uphole or downhole) may be used to accelerate and/or decelerate the expansion process. Accordingly, the applied voltage may be used to accelerate and/or decelerate the setting of any downhole tool that includes the expandable metal. In accordance with one embodiment, a first electrode is located between a first connection of a power source and the expandable metal, and a second electrode is located between a second connection of the power source and a downhole conductive feature. In accordance with this embodiment, the expandable metal is a first side of the electrical circuit, wherein the downhole conductive feature is the second side of the electrical circuit. In at least one embodiment, the electrodes are configured so that at least part of the electrical current passes through fluid surrounding the expandable metal. For example, at least a portion of one or both of the first electrode or the second electrode could be exposed to the wellbore fluid surrounding the expandable metal.

A positive voltage may be applied so that the expandable metal spends at least part of its time as an anode of the circuit. In one embodiment, the positive voltage accelerates the expansion process by up to at least 2×. In another embodiment, the positive voltage accelerates the expansion process by up to at least 5×. In yet another embodiment, the positive voltage accelerates the expansion process by up to at least 10×, and in yet another embodiment of 20× or 100×, or more.

In another embodiment, a negative voltage may be applied so that the expandable metal spends at least part of its time as a cathode of the circuit. In one embodiment, the negative voltage decelerates the expansion process by up to at least 2×. In another embodiment, the negative voltage protects the expanded metal from acid corrosion. For example, a voltage of −2.8 volts may be used to protect a magnesium containing expandable metal from corrosion, a voltage of −1.8 volts may be used to protect an aluminum containing expandable metal from corrosion, and a voltage of −1 volts may be used to protect a zinc containing expandable metal from corrosion, among others.

The electrical power can be applied from a battery, an electrical cable, or from a downhole power generator. In at least one embodiment, the downhole power generator is fluid flow turbine. The voltage, in at least one embodiment, is between 0.01 volts and 200 volts. In yet another embodiment, the voltage is between 0.5 volts and 10 volts. In at least one embodiment, the electrical current is between 0.5 milliamps and 100 amps, and in yet another embodiment is between 0.05 amps and 5 amps.

The power supply can be started from a timer, a transmitted signal through a wire, a transmitted signal sent wirelessly, or from a sensing of the operation of the wellbore, among other mechanisms. In at least one other embodiment, temperature change through fluid swapping could be used as the signal to start the power supply.

Figure 2:
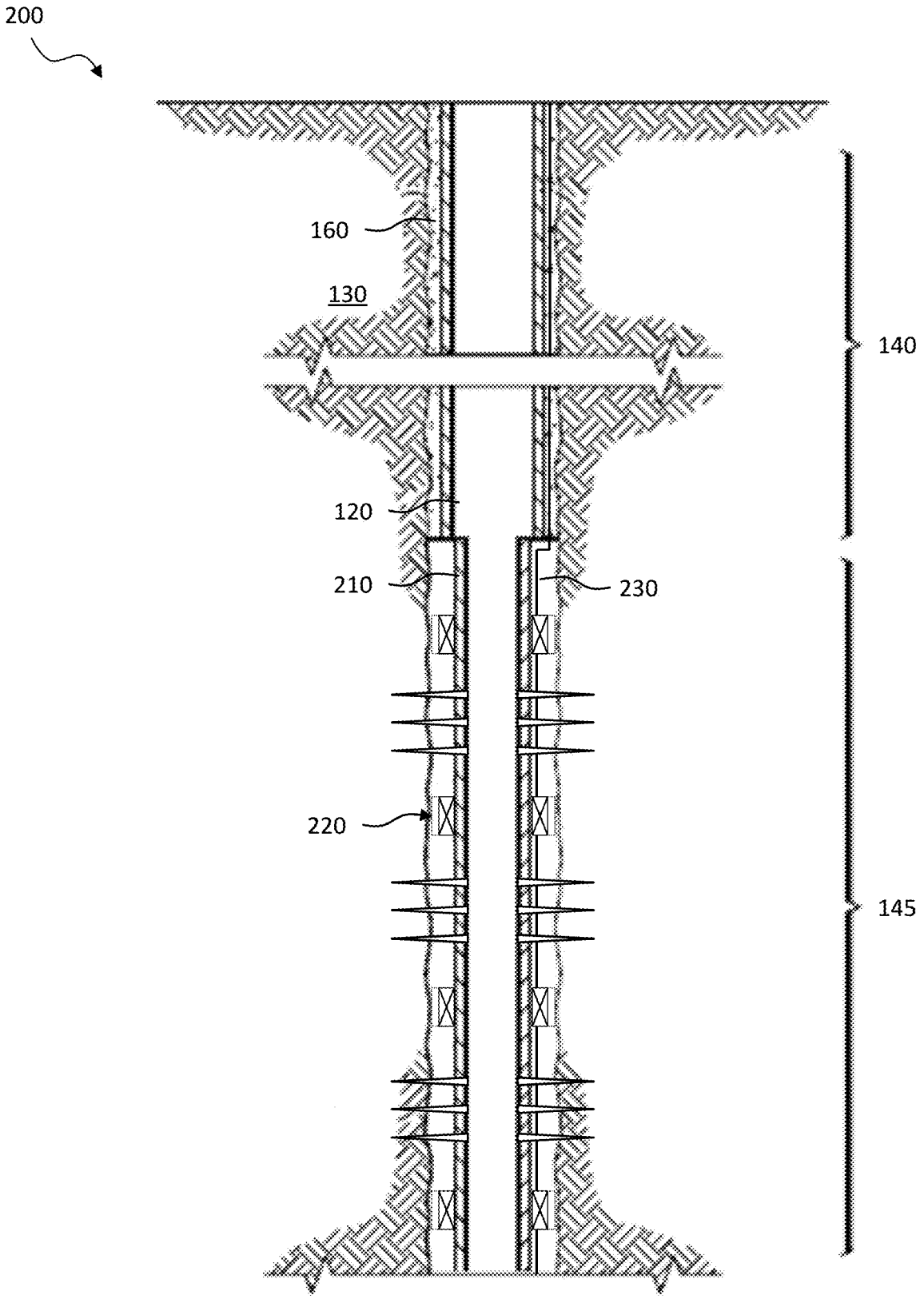
FIG. 2 illustrates a perspective view of an alternative embodiment of a well system including an exemplary operating environment that the apparatuses, systems and methods disclosed herein may be employed.

Referring to FIG. 2, depicted is a perspective view of an alternative embodiment of a well system 200 including an exemplary operating environment that the apparatuses, systems and methods disclosed herein may be employed. The well system 200 is similar in many respects to the well stem 100. Accordingly, like reference numbers have been used to indicate similar, if not identical, features. The well system 200, in contrast to the well system 100, includes a wellbore tubular 210 (e.g., liner hanger) extending from the casing 150 into the open hole region 145. The well system 200 additionally includes one or more downhole packers 220 located in the open hole region 145, thereby isolating the various different production zones within the well system 200. In accordance with at least one embodiment, the one or more downhole packers 220 include the expandable metal configured to expand in response to hydrolysis in accordance with the disclosure. Additionally, the one or more downhole packers 220 are operable to receive a voltage as the expandable metal is expanding in response to wellbore fluid.

In one embodiment, the power (e.g., voltage) is delivered from an electric line 230, such as a TEC (tubing encapsulated conductor), coupled to an uphole power source. The electric line 230 may be connected to sensors and actuators downhole. The electric line 230 may also deliver power (e.g., voltage) to accelerate the chemical reaction of the one or more downhole packers 220. The power (e.g., voltage) can be through a direct connection to the wire or through an inductive coupling or a capacitive coupling. In another embodiment, the power (e.g., voltage) is delivered from a chemical battery, such as a lithium battery or an alkaline battery. In another embodiment, the power (e.g., voltage) is delivered from a fluid-flow driven power generator, such as a turbine power generator.

Figure 3:
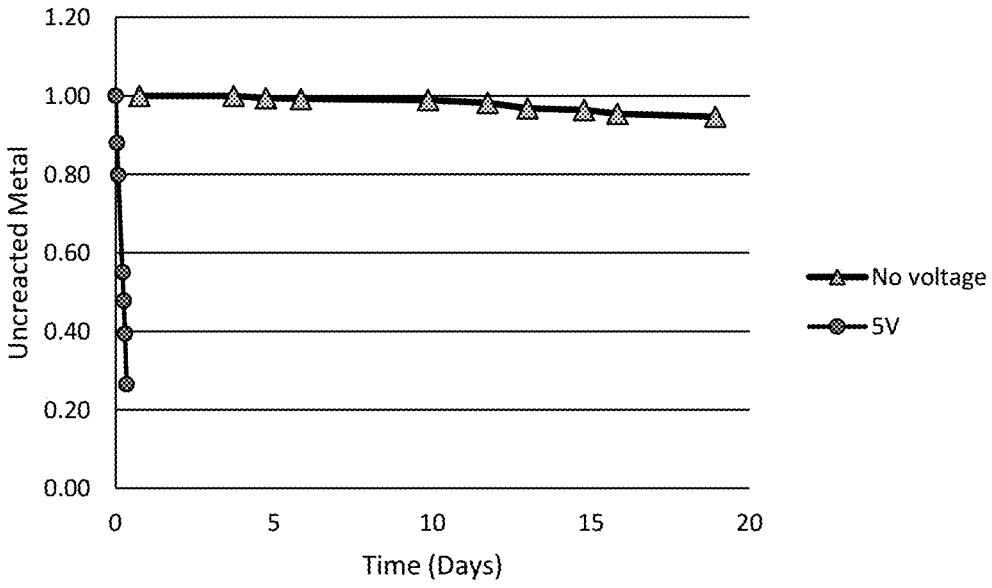
FIG. 3 illustrates a graph showing the unreacted metal versus time for applications employing a voltage and no voltage.

An experiment was conducted, wherein the reaction time of the expandable metal was compared between an applied voltage and no voltage. The mass of the unreacted metal is shown in FIG. 3. As illustrated, applying just a 5 volt signal greatly accelerated the reaction rate.

In an alternative embodiment, the opposite voltage is used to delay the initiation of the chemical reaction. Thus, while applying a positive voltage accelerates the chemical reaction, applying a negative voltage to the expandable metal will inhibit the reaction. This can ensure that the expandable metal does not react (e.g., expand) until the desired time. Additionally, the negative voltage can protect the metal from acid based corrosion.

Figure 4:
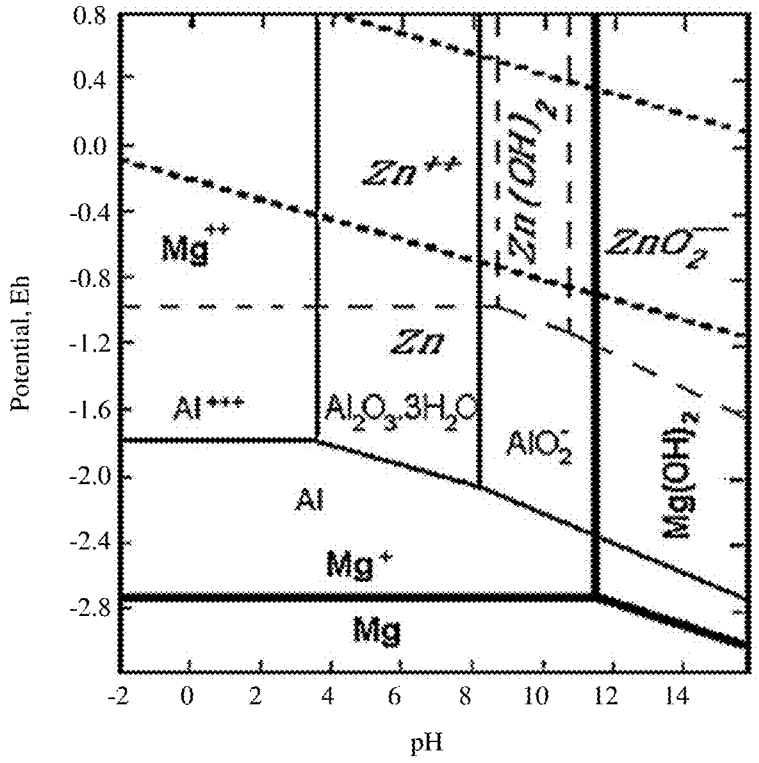
FIG. 4 illustrates a Pourbaix diagram for Mg, Al, and Zn.

A Pourbaix diagram for Mg, Al, and Zn are shown in FIG. 4. Aluminum, magnesium, and zinc will normally dissolve when exposed to acid (pH=0). If a negative voltage is applied to the expandable metal, then the expandable metal will be immune from corrosion. As shown in FIG. 4, applying −2.8V will protect Mg. Applying −1.8V will protect Al. Applying −1V will protect Zn. In one embodiment, a negative voltage is used to delay the reaction of the expandable metal for one period of time and then a positive voltage is used to accelerate the reaction of the expandable metal for a second period of time.

Figure 5:
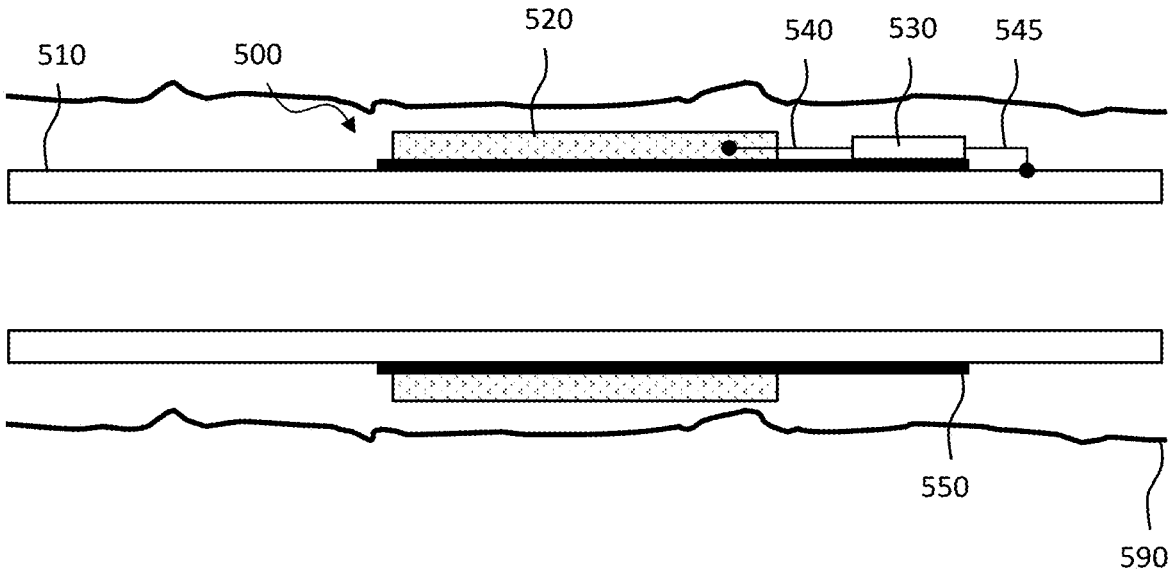
FIGS. 5-15 illustrate various different configurations for a downhole tool including an expandable metal designed and manufactured according to the disclosure.

Turning to FIG. 5, illustrated is a downhole tool 500 (e.g., packer, plug, anchor, etc.) positioned within a wellbore 590. The downhole tool 500 includes a downhole tubular 510 having expandable metal 520 on a surface (e.g., radial surface) thereof. In the illustrated embodiment, the downhole tubular 510 is a downhole conveyance and the expandable metal 520 is one or more expandable metal members positioned on an exterior surface thereof. Nevertheless, it should be understood that any downhole application and use of an expandable metal is within the scope of the present disclosure.

In the illustrated embodiment of FIG. 5, a power source 530 is positioned proximate the expandable metal 520. In accordance with at least one embodiment, a first electrode 540 couples a first connection of the power source 530 with the expandable metal 520, wherein a second electrode 545 couples a second connection of the power source 530 with the downhole tubular 510. In at least one embodiment, the first connection is a positive terminal of the power source 530, thereby causing the expandable metal 520 to function as an anode, and the second connection is a negative terminal of the power source 530, thereby causing the downhole tubular 510 to function as a cathode. For example, a direct current (DC) power source could be coupled to the expandable metal 520 and the downhole tubular 510.

Further to this embodiment, an electrical insulator 550 physically separates the expandable metal 520 and the downhole tubular 510 from one another. This electrical insulator 550 helps to ensure that the electrical current passes through the fluid rather than through direct electrical contact (e.g., by way of a physical connection between the expandable metal 520 and the downhole tubular 510). The electrical insulator 550, thus, reduces the power requirements. As illustrated in FIG. 5, the electrical insulator 550 is a Teflon coating on the downhole tubular 510, but other insulators are within the scope of the disclosure. The electrical insulator 550 is optional but may be useful in reducing the power consumption. The power source can be connected to the electrodes in one, two, or multiple locations.

Figure 6:
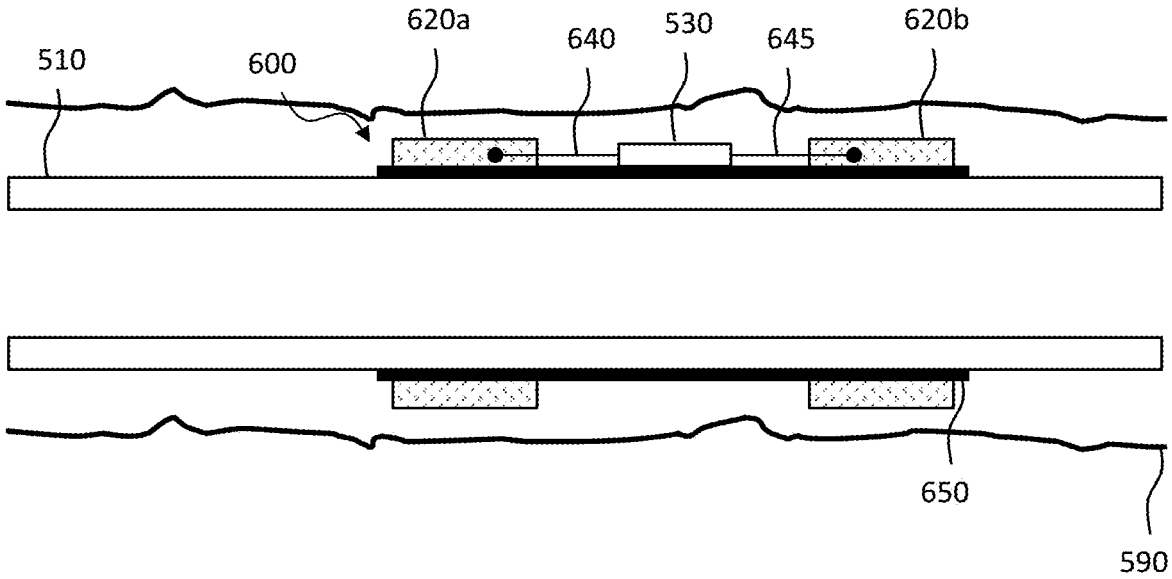

Turning to FIG. 6, illustrated is an alternative embodiment of a downhole tool 600. The downhole tool 600 shares many of the same features as the downhole tool 500. Accordingly, like reference numbers have been used to illustrate similar, if not identical, features. In the illustrated embodiment of FIG. 6, expandable metal 620*a* and 620*b* are used as both conductive features, for example positioned radially about the downhole tubular 510. In accordance with at least one embodiment, a first electrode 640 couples a first connection of the power source 530 with the expandable metal 620*a*, wherein a second electrode 645 couples a second connection of the power source 530 with the expandable metal 620*b*. Electrical power may then be applied to expandable metal 620*a* and expandable metal 620*b*. In the illustrated embodiment, an insulator 650 is applied to the expandable metal 620*a* and expandable metal 620*b*. In some cases, the insulator 650 could just be applied to one of the expandable metal 620*a* or expandable metal 620*b* (e.g., like the anode). In another embodiment, a non-expandable metal, such as a plate or a mesh of stainless steel, titanium, or copper, could couple to the second electrode 645.

In one embodiment, the power is created from a DC voltage. As shown in FIG. 6, one of expandable metal 620*a* or expandable metal 620*b* is the anode and would more rapidly react, while the other of the expandable metal 620*a* or expandable metal 620*b* is the cathode and would have a delayed reaction. In another embodiment, the power is created from an alternating current (AC) voltage. In this configuration, such as that shown in the embodiment of FIG. 6, both sections of the expandable metal 620*a* and expandable metal 620*b* would alternate between being the anode and the cathode, and thus alternate between having a rapid reaction and a delayed reaction.

Figure 7:
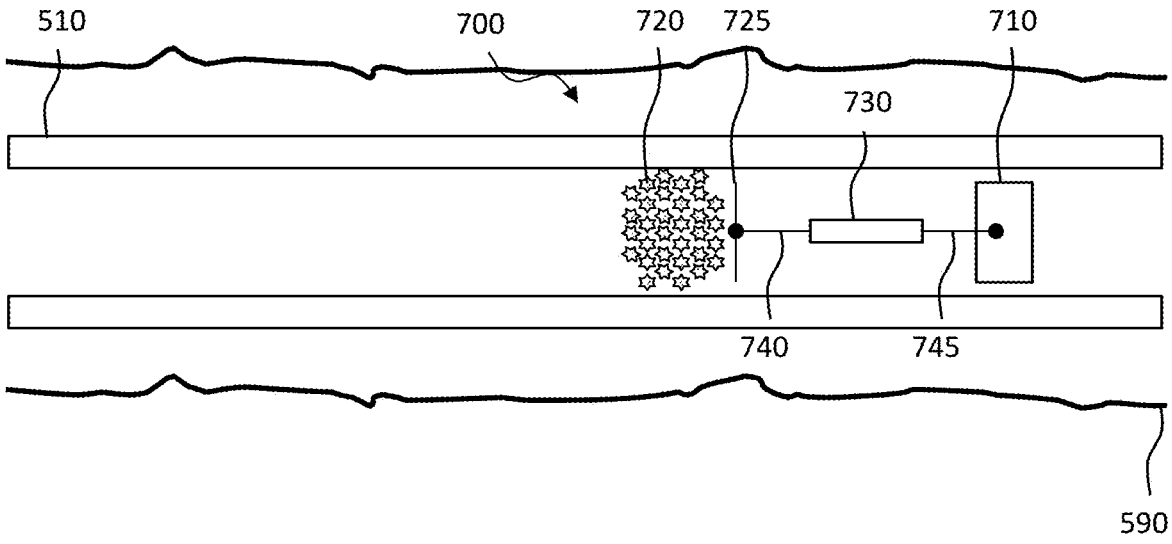

Turning to FIG. 7, illustrated is an alternative embodiment of a downhole tool 700. The downhole tool 700 shares many of the same features as the downhole tool 500. Accordingly, like reference numbers have been used to illustrate similar, if not identical, features. In the illustrated embodiment of FIG. 7, a power source 730 is positioned within the downhole tubular 510 within the wellbore 590. In accordance with at least one embodiment, a first electrode 740 couples a first connection of the power source 730 with a conductive plate 725 coupled to a slurry of expandable metal particles 720, and a second electrode 745 couples a second connection of the power source 730 with a downhole conductive feature 710.

In the illustrated embodiment of FIG. 7, the slurry of expandable metal particles 720 may be flowed into the downhole tubular 510 in the wellbore 590. The slurry of expandable metal particles 720 lands on the conductive plate 725, which at some point (e.g., either after, before, or substantially simultaneously with the slurry of expandable metal particles 720 landing on the conductive plate 725) receives a positive voltage accelerating the expansion thereof. The downhole conductive feature 710 can be in the fluid (as shown) or can be electrically connected with an oilfield tubular (casing).

Figure 8:
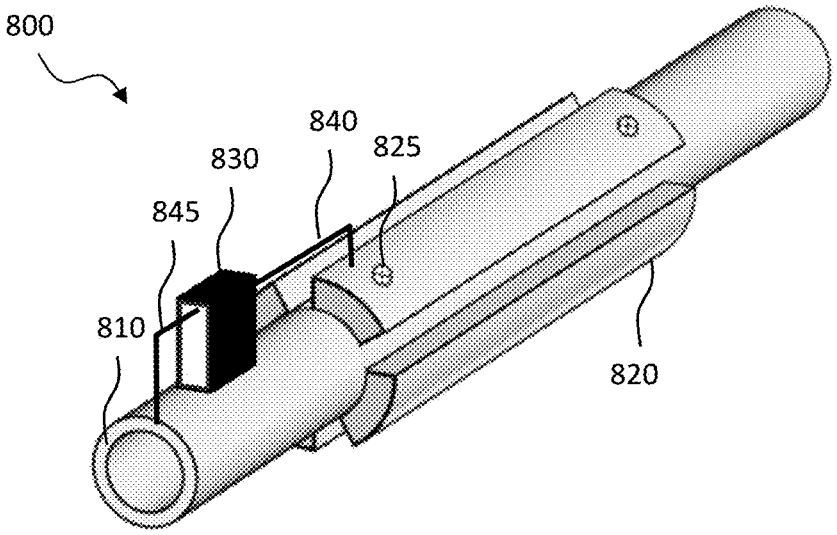

Turning to FIG. 8, illustrated is yet another alternative embodiment of a downhole tool 800 designed, manufactured and operated according to one aspect of the disclosure. The downhole tool 800 may be an expandable metal wellbore anchor or an expandable metal packer or seal, among other downhole tools. In accordance with one embodiment of the disclosure, the downhole tool 800 includes one or more expandable metal members 820 positioned on a downhole tubular 810. While the downhole tubular 810 illustrated in FIG. 8 is API pipe, other embodiments may exist wherein another type conveyance is used.

The one or more expandable metal members 820, in accordance with the disclosure, comprise a metal configured to expand in response to hydrolysis, as discussed in detail above. Furthermore, a combined volume of the one or more expandable metal members should be sufficient to expand to anchor one or more downhole tools within the wellbore in response to the hydrolysis. In one embodiment, the combined volume of the one or more expandable metal members 820 is sufficient to expand to anchor at least about 100,000 Newtons (e.g., about 25,000 lbs.) of weight within the wellbore. In yet another embodiment, the combined volume of the one or more expandable metal members 820 is sufficient to expand to anchor at least about 200,000 Newtons (e.g., about 50,000 lbs.) of weight within the wellbore, and in yet another embodiment sufficient to expand to anchor at least about 300,000 Newtons (e.g., about 70,000 lbs.) of weight within the wellbore. In one embodiment, for example where the one or more expandable metal members 820 are seals, they may be capable of holding pressures up to about 1000 psi. In another embodiment, the one or more expandable metal members are capable of holding pressures up to about 10,000 psi, and in even yet another embodiment up to about 20,000 psi, or more.

In the illustrated embodiment of FIG. 8, two or more expandable metal members 820 (e.g., four expandable metal members in the embodiment shown) are axially positioned along and substantially equally radially spaced about the downhole tubular 810. In the illustrated embodiment, the two or more expandable metal members 820 include openings extending entirely through a wall thickness thereof for accepting a fastener 825 (e.g., a set screw in one embodiment) for fixing to the downhole tubular 810. As those skilled in the art now appreciate, the two or more expandable metal members 820 will expand to engage with the wellbore (e.g., cased region of the wellbore or open hole region of the wellbore) when subjected to a suitable fluid, including a brine based fluid, and thus act as a wellbore anchor and/or wellbore packer.

In the illustrated embodiment of FIG. 8, the downhole tool 800 includes a power source 830. In accordance with the disclosure, a first electrode 840 is coupled between the one or more expandable metal members 820 and a first connection of the power source 830, and a second electrode 845 is coupled between the downhole tubular 810 and a second connection of the power source 830. The power source 830, and the connections between the power source 830 and the one or more expandable metal members 820, may be similar in many respects to the power source 530 discussed above, and thus may be used to accelerate the expansion of the one or more expandable metal members 820.

Figure 9:
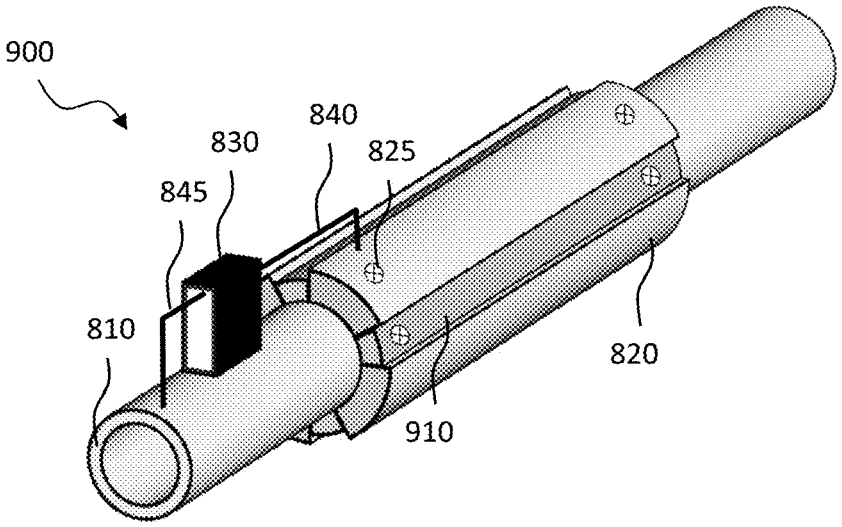

Turning to FIG. 9, illustrated is yet another alternative embodiment of a downhole tool 900 designed, manufactured and operated according to one aspect of the disclosure. The downhole tool 900 is similar in many respects to the downhole tool 800. Accordingly, like reference numerals have been used to reference similar, if not identical, features. The downhole tool 900 differs from the downhole tool 800 primarily in that it includes two or more spacers 910 radially interleaving the two or more expandable metal members 820. The two or more spacers 910 may comprise a variety of different materials and remain within the scope of the disclosure. In the embodiment of FIG. 9, the two or more spacers 910 do not comprise the metal configured to expand in response to hydrolysis, and thus do not expand. For example, the two or more spacers 910 could comprise steel.

Figure 10:
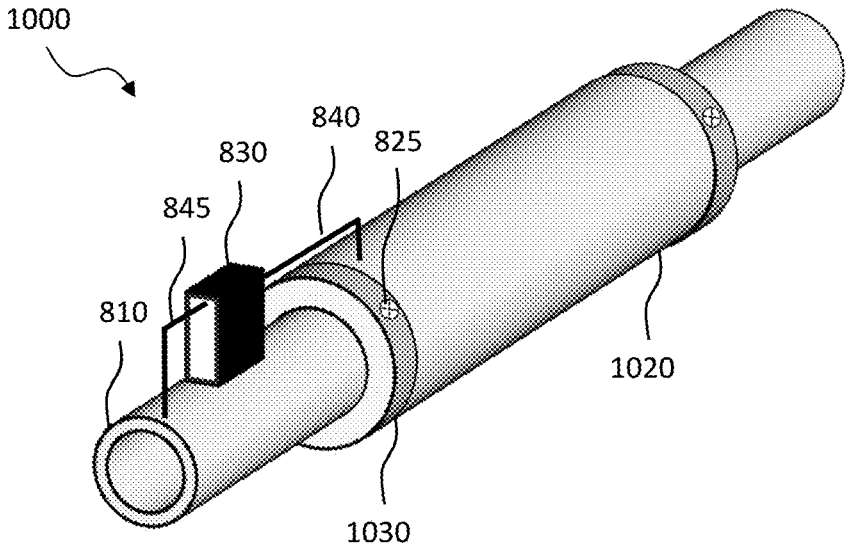

Turning to FIG. 10, illustrated is yet another alternative embodiment of a downhole tool 1000 designed, manufactured and operated according to one aspect of the disclosure. The downhole tool 1000 is similar in certain respects to the downhole tool 800. Accordingly, like reference numerals have been used to reference similar, if not identical, features. The downhole tool 1000 includes a single elongate toroidal expandable metal member 1020 positioned around the downhole tubular 810. The single elongate toroidal expandable metal member 1020 may comprise one or more of the expandable metals discussed above. Moreover, the single elongate toroidal expandable metal member 1020 need not have a circular opening or circular exterior, and thus could comprise a rectangle, another polygon, or any other suitable shape.

In the particular embodiment of FIG. 10, the single elongate toroidal expandable metal member 1020 is held in place on the downhole conveyance 810 using a pair of retaining rings 1030, for example positioned adjacent a proximal end and a distal end of the single elongate toroidal expandable metal member 1020. In accordance with one embodiment of the disclosure, the pair of retaining rings 1030 does not comprise the metal configured to expand in response to hydrolysis, and moreover include one or more fasteners 825 for holding the single elongate toroidal expandable metal member 1020 in place.

Figure 11:
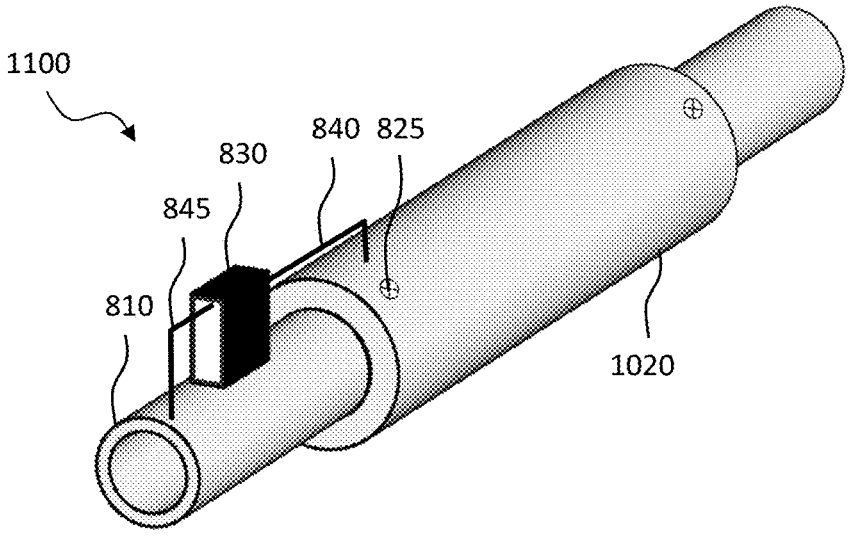

Turning to FIG. 11, illustrated is yet another alternative embodiment of a downhole tool 1100 designed, manufactured and operated according to one aspect of the disclosure. The downhole tool 1100 is similar in many respects to the downhole tool 1000. Accordingly, like reference numerals have been used to reference similar, if not identical, features. The downhole tool 1100 includes the single elongate toroidal expandable metal member 1020 positioned around the downhole tubular 810. The downhole tool 1100, however, does not employ retaining rings 1020. In contrast, the expandable metal downhole tool 1100 positions the sets screws 825 directly in openings extending entirely through a wall thickness of the single elongate toroidal expandable metal member 1020.

Figure 12:
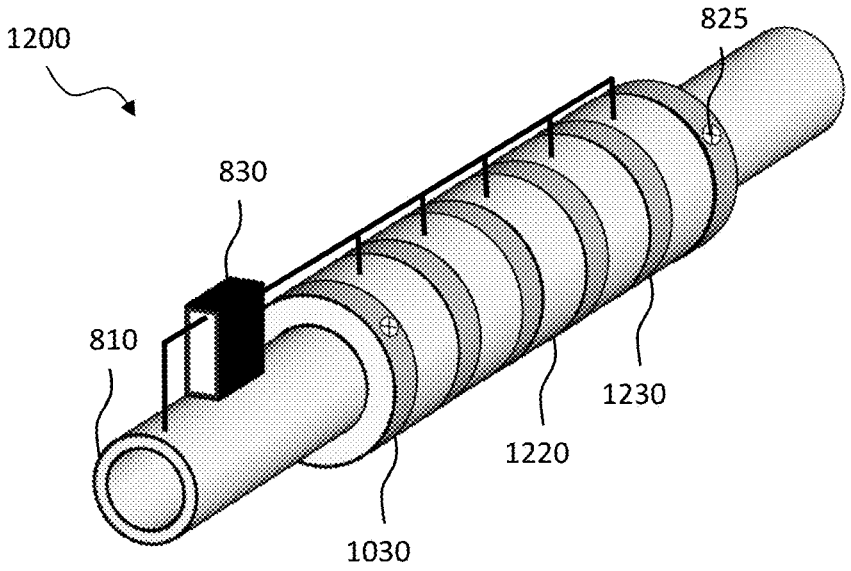

Turning to FIG. 12, illustrated is yet another alternative embodiment of a downhole tool 1200 designed, manufactured and operated according to one aspect of the disclosure. The downhole tool 1200 is similar in certain respects to the downhole tool 1000. Accordingly, like reference numerals have been used to reference similar, if not identical, features. The downhole tool 1200 includes two or more toroidal expandable metal members 1220 positioned around the downhole tubular 810. In fact, in the embodiment of FIG. 12, five toroidal expandable metal members 1220 are used. The two or more toroidal expandable metal members 1220 may comprise one or more of the expandable metals discussed above.

The downhole tool 1200 illustrated in FIG. 12 additionally includes one or more spacers 1230 axially interleaving the two or more toroidal expandable metal members 1220. In the illustrated embodiment of FIG. 12, the one or more spacers 1230 do not comprise the metal configured to expand in response to hydrolysis. The downhole tool 1200 additionally includes a pair of retaining rings 1030. In accordance with one embodiment of the disclosure, the pair of retaining rings 1030 does not comprise the metal configured to expand in response to hydrolysis, and moreover include one or more fasteners 825.

Figure 13:
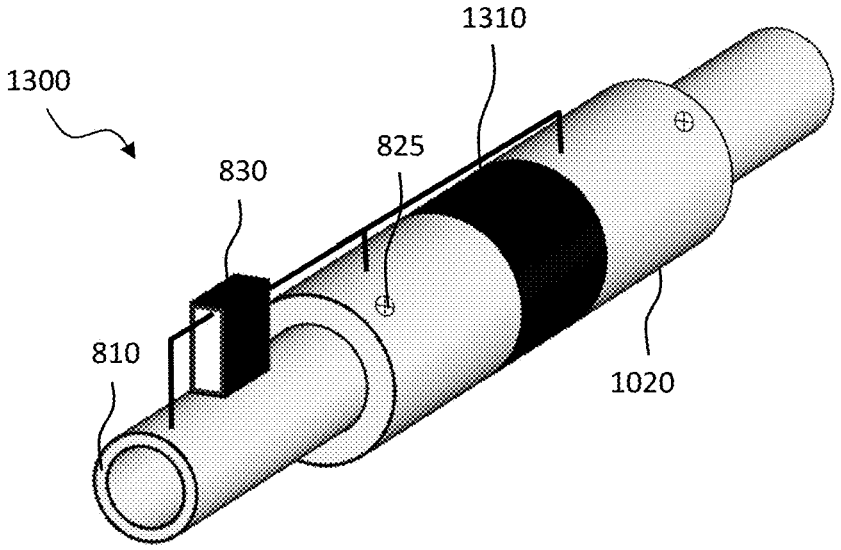

Turning to FIG. 13, illustrated is yet another alternative embodiment of a downhole tool 1300 designed, manufactured and operated according to one aspect of the disclosure. The downhole tool 1300 is similar in certain respects to the downhole tool 1100. Accordingly, like reference numerals have been used to reference similar, if not identical, features. The downhole tool 1300 additionally includes a swellable rubber member 1310 positioned proximate the one or more expandable metal members 1020. The swellable rubber member 1310, in the illustrated embodiment, is configured to swell in response to contact with one or more downhole reactive fluids to pressure seal the wellbore, as well as function as a wellbore anchor. In one embodiment, the swellable rubber reactive fluid may be a diesel solution, or other similar water-based solution.

In the illustrated embodiment of FIG. 13, the swellable rubber member 1310 is positioned between a pair of expandable metal members 1020. In another embodiment, the swellable rubber member 1310 could be placed around at least a portion of the one or more expandable metal members 1020, and in yet another embodiment could be placed proximate an axial end of the one or more expandable metal members 1020, among other locations.

Figure 14:
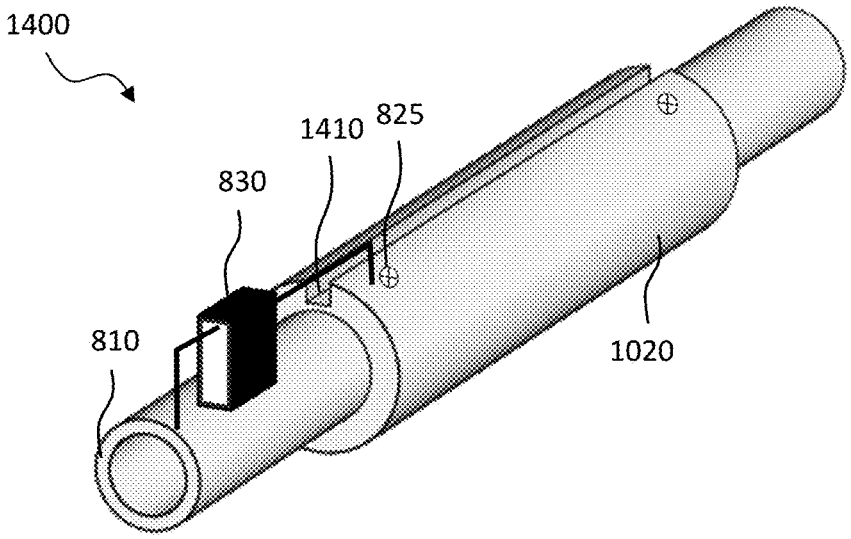

Turning to FIG. 14, illustrated is yet another alternative embodiment of a downhole tool 1400 designed, manufactured and operated according to one aspect of the disclosure. The downhole tool 1400 is similar in certain respects to the downhole tool 1100. Accordingly, like reference numerals have been used to reference similar, if not identical, features. The downhole tool 1400 additionally includes one or more axial grooves 1410 extending along an entire length thereof. The axial groove 1410 may comprise a variety of shapes and locations and remain within the scope of the present disclosure. In accordance with one embodiment of the disclosure, the one or more axial grooves 1410 may be used to provide fluid flow past the downhole tool 1400, as well as act as a electric cable (e.g., TEC) or other feature bypass (e.g., no splicing required) for the downhole tool 1400.

Figure 15:
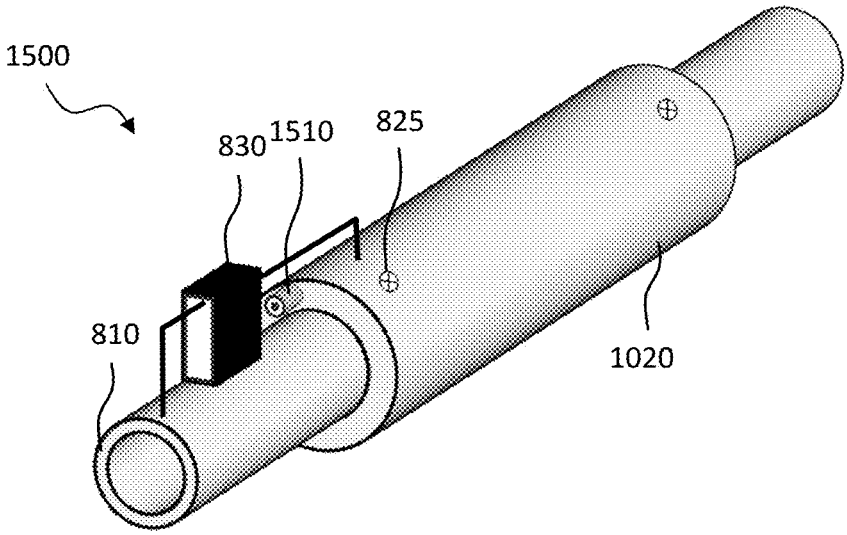

Turning to FIG. 15, illustrated is yet another alternative embodiment of a downhole tool 1500 designed, manufactured and operated according to one aspect of the disclosure. The downhole tool 1500 is similar in certain respects to the downhole tool 1100. Accordingly, like reference numerals have been used to reference similar, if not identical, features. The downhole tool 1500 additionally includes one or more passageways 1510 (e.g., comprising one or more shunt tubes in one embodiment) extending along an entire length thereof. The one or more passageways 1510, in accordance with the disclosure, provide fluid flow past the downhole tool 1500. In accordance with one embodiment, the one or more passageways 1510 do not comprise the metal configured to expand in response to hydrolysis, and thus should remain open. In the illustrated embodiment of FIG. 15, the one or more passageways 1510 are positioned in a wall thickness of the toroidal expandable metal member 1020, but they could be in other locations, including the axial groove 1410 discussed above with regard to FIG. 14.

Aspects disclosed herein include:

A. A method for setting a downhole tool, the method including: 1) positioning a downhole tool within a wellbore, the downhole tool including expandable metal configured to expand in response to hydrolysis; 2) subjecting the expandable metal to a wellbore fluid to expand the expandable metal into contact with one or more surfaces; and 3) applying a voltage to the expandable metal while the expandable metal is being subjected to the wellbore fluid.

B. A downhole tool, the downhole tool including: 1) a downhole conductive feature; expandable metal positioned proximate the downhole conductive feature, the expandable metal configured to expand in response to hydrolysis; 2) a first electrode coupled to the expandable metal and operable to couple to a first connection of a power source, and thereby provide a voltage to the expandable metal; and 3) a second electrode coupled to the downhole conductive feature and operable to couple to a second connection of the power source.

C. A well system, the well system including: 1) a wellbore extending through one or more subterranean formations; 2) a power source, the power source including a first connection and a second connection; and 3) a downhole tool located within the wellbore, the downhole tool including; a) a downhole conductive feature; b) expandable metal positioned proximate the downhole conductive feature, the expandable metal configured to expand in response to hydrolysis; c) a first electrode coupled between the expandable metal and the first connection of the power source, the first electrode operable to provide a voltage to the expandable metal; and d) a second electrode coupled between the downhole conductive feature and the second connection of the power source.

Aspects A, B, and C may have one or more of the following additional elements in combination: Element 1: further including coupling a first electrode between a first connection of a power source and the expandable metal, and coupling a second electrode between a second connection of the power source and a downhole conductive feature. Element 2: wherein at least a portion of the first electrode is electrically exposed to the wellbore fluid. Element 3: wherein at least a portion of the second electrode is electrically exposed to the wellbore fluid. Element 4: wherein an electrical insulator physically separates the expandable metal and the downhole conductive feature. Element 5: wherein the first connection is a positive terminal of the power source, thereby causing the expandable metal to function as an anode, and the second connection is a negative terminal of the power source, thereby causing the downhole conductive feature to function as a cathode. Element 6: wherein the downhole conductive feature is conductive tubing located within the wellbore. Element 7: wherein the power source is a direct current (DC) power source. Element 8: wherein the expandable metal is a first expandable metal feature and the downhole conductive feature is a second expandable metal feature. Element 9: wherein the first expandable metal feature and the second expandable metal feature are positioned radially about a conductive tubular. Element 10: further including one or more electrical insulators physically separating at least one of the first expandable metal feature and the second expandable from the conductive tubular. Element 11: wherein the power source is an alternating current (AC) power source, the alternating current (AC) power source causing the first expandable metal to alternate between functioning as an anode and a cathode and causing the second expandable metal feature to oppositely alternative between functioning as the cathode and the anode. Element 12: wherein the expandable metal is a slurry of expandable metal particles, and further including a conductive plate coupled to the first electrode for applying the voltage to the slurry of expandable metal particles. Element 13: wherein the voltage is a positive voltage operable to accelerate the expansion of the expandable metal. Element 14: wherein the voltage is a negative voltage operable to decelerate the expansion of the expandable metal. Element 15: wherein the voltage is a negative voltage operable to protect the expandable metal from acid corrosion. Element 16: wherein the voltage ranges from 0.01 volts to 200 volts. Element 17: wherein the voltage ranges from 0.5 volts to 10 volts. Element 18: wherein a current associated with the voltage ranges from 0.05 amps to 5 amps. Element 19: wherein the downhole conductive feature is conductive tubing positionable within a wellbore. Element 20: wherein the expandable metal is a first expandable metal feature and the downhole conductive feature is a second expandable metal feature. Element 21: wherein the first expandable metal feature and the second expandable metal feature are positioned radially about a conductive tubular. Element 22: further including one or more electrical insulators physically separating at least one of the first expandable metal feature and the second expandable from the conductive tubular. Element 23: wherein the downhole conductive feature is conductive tubing positioned within the wellbore. Element 24: wherein the expandable metal is a first expandable metal feature and the downhole conductive feature is a second expandable metal feature. Element 25: wherein the first expandable metal feature and the second expandable metal feature are positioned radially about a conductive tubular. Element 26: further including one or more electrical insulators physically separating at least one of the first expandable metal feature and the second expandable from the conductive tubular. Element 27: wherein the power source is a downhole battery power supply. Element 28: wherein the power source is a downhole power generator. Element 29: wherein the power source is an uphole power source, and further including an electric line extending from the uphole power source to the downhole tool. Element 30: wherein the electric line is a tubing encapsulate conductor (TEC). Element 31: wherein the downhole tool is a downhole tool is a packer. Element 32: wherein the downhole tool is a downhole anchor.

Those skilled in the art to which this application relates will appreciate that other and further additions, deletions, substitutions and modifications may be made to the described embodiments.

What is claimed is:

1. A method for setting a downhole tool, comprising:

positioning a downhole tool within a wellbore, the downhole tool including expandable metal configured to expand in response to hydrolysis, the expandable metal including an alkaline earth metal or a transition metal;

subjecting the expandable metal to a wellbore fluid to expand the expandable metal into contact with one or more surfaces, wherein while subjecting the expandable metal to the wellbore fluid the expandable metal goes from metal to micron scale particles that expand and lock together; and applying a voltage to the expandable metal while the expandable metal is being subjected to the wellbore fluid.

2. The method as recited in claim 1, further including coupling a first electrode between a first connection of a power source and the expandable metal, and coupling a second electrode between a second connection of the power source and a downhole conductive feature.

3. The method as recited in claim 2, wherein at least a portion of the first electrode is electrically exposed to the wellbore fluid.

4. The method as recited in claim 3, wherein at least a portion of the second electrode is electrically exposed to the wellbore fluid.

5. The method as recited in claim 2, wherein an electrical insulator physically separates the expandable metal and the downhole conductive feature.

6. The method as recited in claim 2, wherein the first connection is a positive terminal of the power source, thereby causing the expandable metal to function as an anode, and the second connection is a negative terminal of the power source, thereby causing the downhole conductive feature to function as a cathode.

7. The method as recited in claim 2, wherein the downhole conductive feature is conductive tubing located within the wellbore.

8. The method as recited in claim 7, wherein the power source is a direct current (DC) power source.

9. The method as recited in claim 2, wherein the expandable metal is a first expandable metal feature and the downhole conductive feature is a second expandable metal feature.

10. The method as recited in claim 9, wherein the first expandable metal feature and the second expandable metal feature are positioned radially about a conductive tubular.

11. The method as recited in claim 10, and further including one or more electrical insulators physically separating at least one of the first expandable metal feature and the second expandable from the conductive tubular.

12. The method as recited in claim 9, wherein the power source is an alternating current (AC) power source, the alternating current (AC) power source causing the first expandable metal to alternate between functioning as an anode and a cathode and causing the second expandable metal feature to oppositely alternative between functioning as the cathode and the anode.

13. The method as recited in claim 2, wherein the expandable metal is a slurry of expandable metal particles, and further including a conductive plate coupled to the first electrode for applying the voltage to the slurry of expandable metal particles.

14. The method as recited in claim 1, wherein the voltage is a positive voltage operable to accelerate the expansion of the expandable metal.

15. The method as recited in claim 1, wherein the voltage is a negative voltage operable to decelerate the expansion of the expandable metal.

16. The method as recited in claim 1, wherein the voltage is a negative voltage operable to protect the expandable metal from acid corrosion.

17. The method as recited in claim 1, wherein the voltage ranges from 0.01 volts to 200 volts.

18. The method as recited in claim 1, wherein the voltage ranges from 0.5 volts to 10 volts.

19. The method as recited in claim 1, wherein a current associated with the voltage ranges from 0.05 amps to 5 amps.

20. The method as recited in claim 1, wherein the downhole tool is a conductive downhole tool.

* * * * *